US006692172B1

(12) United States Patent
Hsu

(10) Patent No.: US 6,692,172 B1
(45) Date of Patent: Feb. 17, 2004

(54) MOP ASSEMBLY WITH LIQUID DETERGENT SUPPLY

(76) Inventor: Hsing-Yuan Hsu, No. 16, Lane 96, Shu Te Street, Ta Ya Hsiang, Taichung Hsien (TW)

( * ) Notice: Subject to any disclaimer, the term of this patent is extended or adjusted under 35 U.S.C. 154(b) by 0 days.

(21) Appl. No.: 10/412,212

(22) Filed: Apr. 14, 2003

(51) Int. Cl.[7] ..... A47L 1/08; A47L 13/22; A47L 13/26; A47L 13/30

(52) U.S. Cl. ..... 401/138; 401/279; 401/268; 15/104.93

(58) Field of Search ..... 401/138, 277–279, 401/207, 268, 137; 15/104.93, 231

(56) References Cited

U.S. PATENT DOCUMENTS 5,876,141 A * 3/1999 Hsu ..... 401/207
6,227,744 B1 * 5/2001 Fodrocy et al. ..... 401/138
6,305,046 B1 * 10/2001 Kingry et al. ..... 15/231
6,540,424 B1 * 4/2003 Hall et al. ..... 401/138
6,612,768 B2 * 9/2003 Zorzo ..... 401/138

FOREIGN PATENT DOCUMENTS

JP 08266456 A * 10/1996 ..... A47L/13/24

* cited by examiner

*Primary Examiner*—Tuan N. Nguyen
(74) *Attorney, Agent, or Firm*—Troxell Law Office PLLC

(57) ABSTRACT

A mop assembly with liquid detergent supply has a detergent storage bottle connected between the mop and the handle of a mop, a pump installed inside the storage bottle, a sucking tube disposed at one end of the pump, and an outlet nozzle connected with the storage bottle disposed on the other end of the pump, so that the handle pushes the pump and compresses a spring to resume the pump into its original position. Such back and forth movement squeezes the liquid detergent out from the pump and sucks liquid detergent into the pump when the pump resumes its position, and thus spraying the detergent out from the outlet nozzle. By means of the handle directly driving the pump in the storage bottle for the back and forth squeezing, it gives the convenience of supplying detergent before mopping. Furthermore, an n-shape contractible support rod is disposed each on both sides of the mop to fit mops of different specifications, and thus having the effect of expanding the applications.

10 Claims, 14 Drawing Sheets

MOP ASSEMBLY WITH LIQUID DETERGENT SUPPLY

BACKGROUND OF THE INVENTION

1. Field of the Invention

The present invention relates to an improved mop assembly with liquid detergent supply, comprising a detachable storage bottle, a detachable handle, and a detachable mop that constitute a linear body after assembling the foregoing components. By means of the reciprocating movement of the handle, the pump in the storage bottle is squeezed to convey the detergent for convenient use, and the present invention can reduce the packaging volume for transportation and lower the cost. Additionally, a contractible support rod is disposed on each on both sides of the mop to fit the mops of different specifications and thus enhancing the cost-effectiveness of such technical area.

2. Description of the Related Art

A mop is a common cleaning tool that has existed for a long time. It is generally used together with a piece of cotton cloth or a polyester cloth to offer convenience of cleaning highly recognized by consumers. However, when a user needs to remove dirt by liquids such as clean water or liquid detergent, it is necessary to spray the dirty place first and wipe off the dirt by a mop, and thus causing inconvenience to users for such operation. Therefore, the following prior arts came to their place:

(1) The first prior art hangs a storage bottle on the handle of a mop and installs a small direct current pump outside the storage bottle; a press switch is disposed at the top of the handle; an electric cable extends along the exterior of a pipe of the sectional handle to such small electric pump for supplying power from a battery outside the storage bottle; and by means of pressing the switch, the electric pump is controlled to spray liquid detergent from the storage bottle.

(2) The second prior art also sets a press switch at the top of the handle of a mop, and uses the siphon principle of an air pump as well as extends the pipeline from the interior of the pipe of the handle into a storage bottle. By pressing the switch, the air pump is controlled to spray the liquid detergent.

The aforementioned first prior art still has the following shortcomings:

(1) The storage bottle is hung outside the handle of the mop. Since the storage bottle protrudes from the outer side, and liquid detergent is stored in the storage bottle when the mop is being used, the center of gravity deviates from the mop, which causes an unstable operation of the mop.

(2) Battery is used as power supply to the electric pump, and the power consumption is large. It is necessary to replace the battery quite often, and causes inconvenience to its use. The storage bottle is, dipped or wetted by the liquid detergent easily, and causes corrosions and damages to the battery and the battery compartment.

(3) The electric cable is installed in the pipe of a sectional handle, which makes the assembling procedure complicated and increases costs. In addition, when the mops are packed separately, the volume is larger and thus increasing the volume of material for transportation as well as the transportation cost.

(4) The electric cable installed in the pipe of the sectional handle has a specific length, so that the length of the handle cannot be adjusted according to the height of the user, which limits its use.

(5) The foregoing mop is of a fixed specification, and cannot be used together with a longer piece of cloth for the mops of other specifications.

The aforementioned second prior art still has the following shortcomings:

(1) Since the press switch is installed at the top of the handle, and there is a pipeline inside the pipe of the sectional handle. To detach the sections of the handle, a pipe connector is needed at each end of the joint for the connection of the sections of the handle. Air leakage may occur and make the operation impossible if such joint is loosened during the assembling or while the mop is in use.

(2) The assembling procedure of the aforementioned handle is complicated, and thus increasing the cost.

(3) The foregoing storage bottle is hung outside the front of the handle of the mop. Since the storage bottle stores liquid detergent and its center of gravity deviates from the mop, causing an unstable operation.

(4) Since the pipeline is too long, it is difficult for the air pump to provide a fixed quantity of the sprayed liquid detergent. It is necessary to press the press switch many times to spray the required amount of detergent, and thus making the use time-consuming and a waste of efforts.

(5) The foregoing mop is also of fixed specification, and cannot be used together with a longer piece of cloth of other specifications.

SUMMARY OF THE INVENTION

The primary objective of the present invention is to solve the foregoing problems by taking the following measures.

(1) The present invention directly connects a storage bottle with a sectional handle and a mop, such that the center of gravity of the storage bottle falls onto the mop, and makes the operation stable for users, and can reduce the volume of material for individual packaging and lower the transportation cost.

(2) A pump is installed inside the storage bottle, and the back-and-forth pressing movement drives the handle to squeeze the pump in a longitudinal direction, and the compression is larger than that of the aforementioned electric pump, so that the liquid detergent can be spread out and sprayed evenly.

(3) There is no pipeline or electric cable inside the pipe of the sectional pipe in accordance with the present invention, which makes the assembly easy and saves assembling costs. In addition, the length of the sectional handle can be adjusted according to the height of the user, which flexibly expands the effect of its applications.

(4) The mop of the present invention has a contractible support rod at the interior of both sides to provide the extension of the mop's length and fit the cloths of different specifications.

Therefore, the present invention can achieve the following effects:

(1) The present invention makes the assembling easy, saves costs, reduces the volume of material after packaging individually, and lowers the transportation cost.

(2) The present invention is easy to operate, and gives a larger quantity of sprayed liquid detergent.

(3) The present invention provides a stable operation for users without the phenomenon of deviated center of gravity.

(4) There is no pipeline or electric cable inside the sectional handle, and the length of the handle can be adjusted according to the height of the user.

(5) The mop of the present invention allows contractible adjustments to fit the cloths of different specifications and thus expanding the effect of its applications.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

To make it easier for our examiner to understand the objective of the invention, its structure, innovative features, and performance, we use two preferred embodiments together with the attached drawings for the detailed description of the invention.

Figure 1:
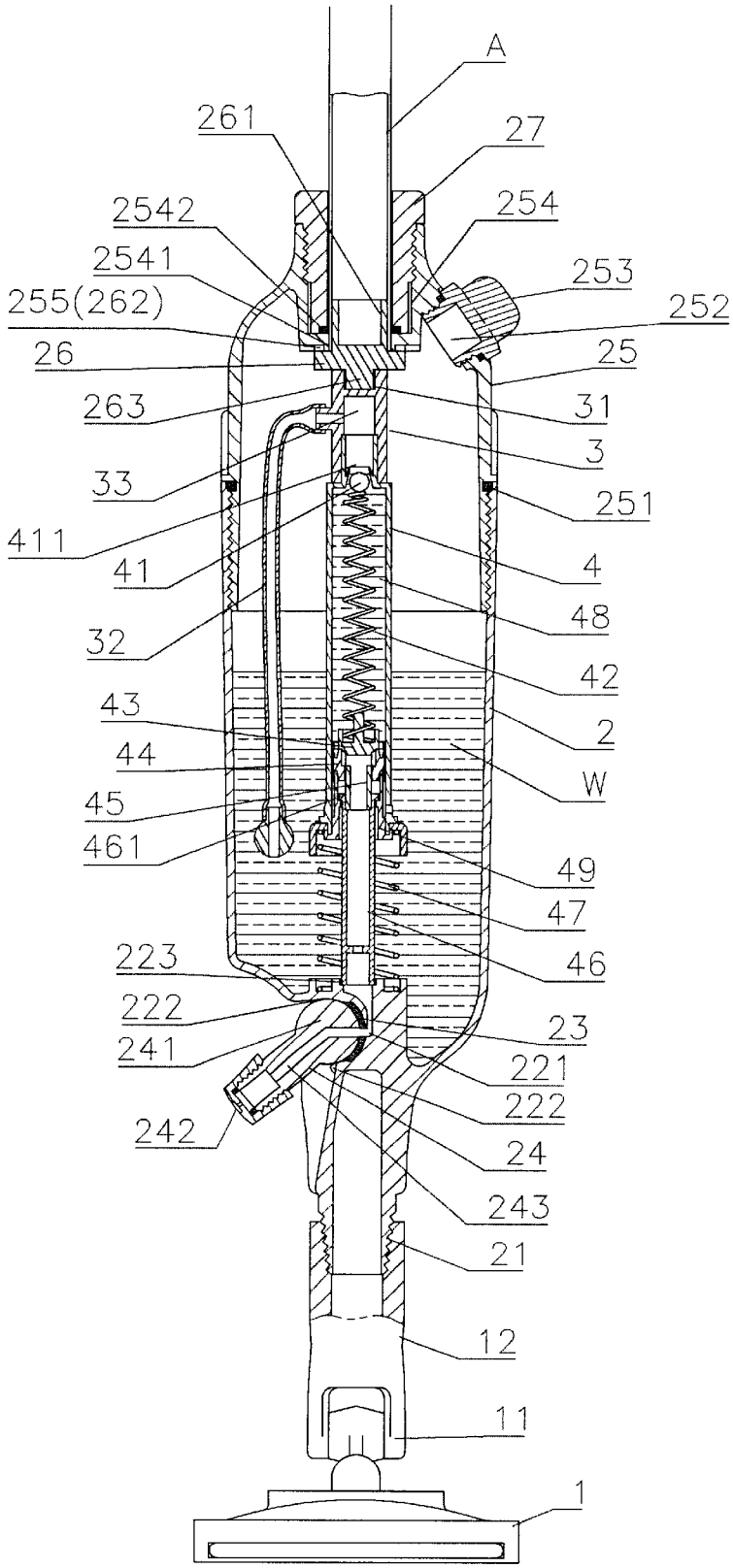
FIG. 1 is a cross-sectional diagram of the assembled structure of the present invention.
Figure 2:
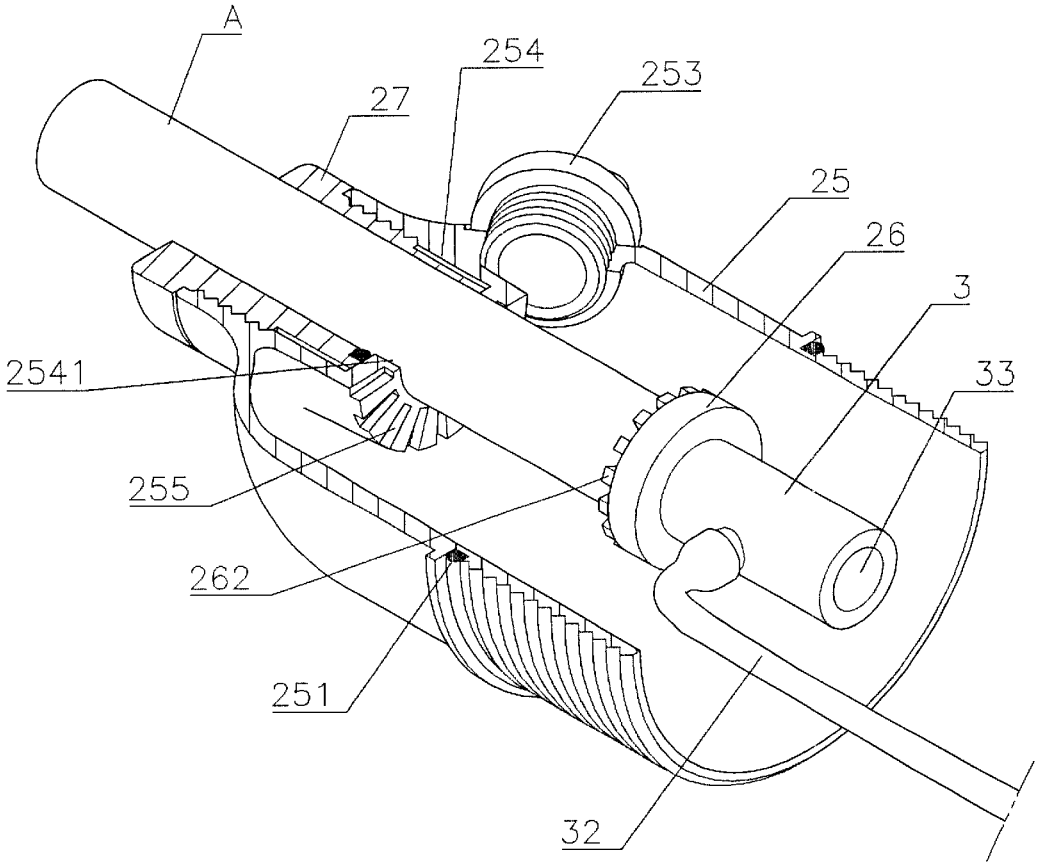
FIG. 2 is a perspective cross-sectional diagram of the fixed bottle cover of the present invention.
Figure 3:
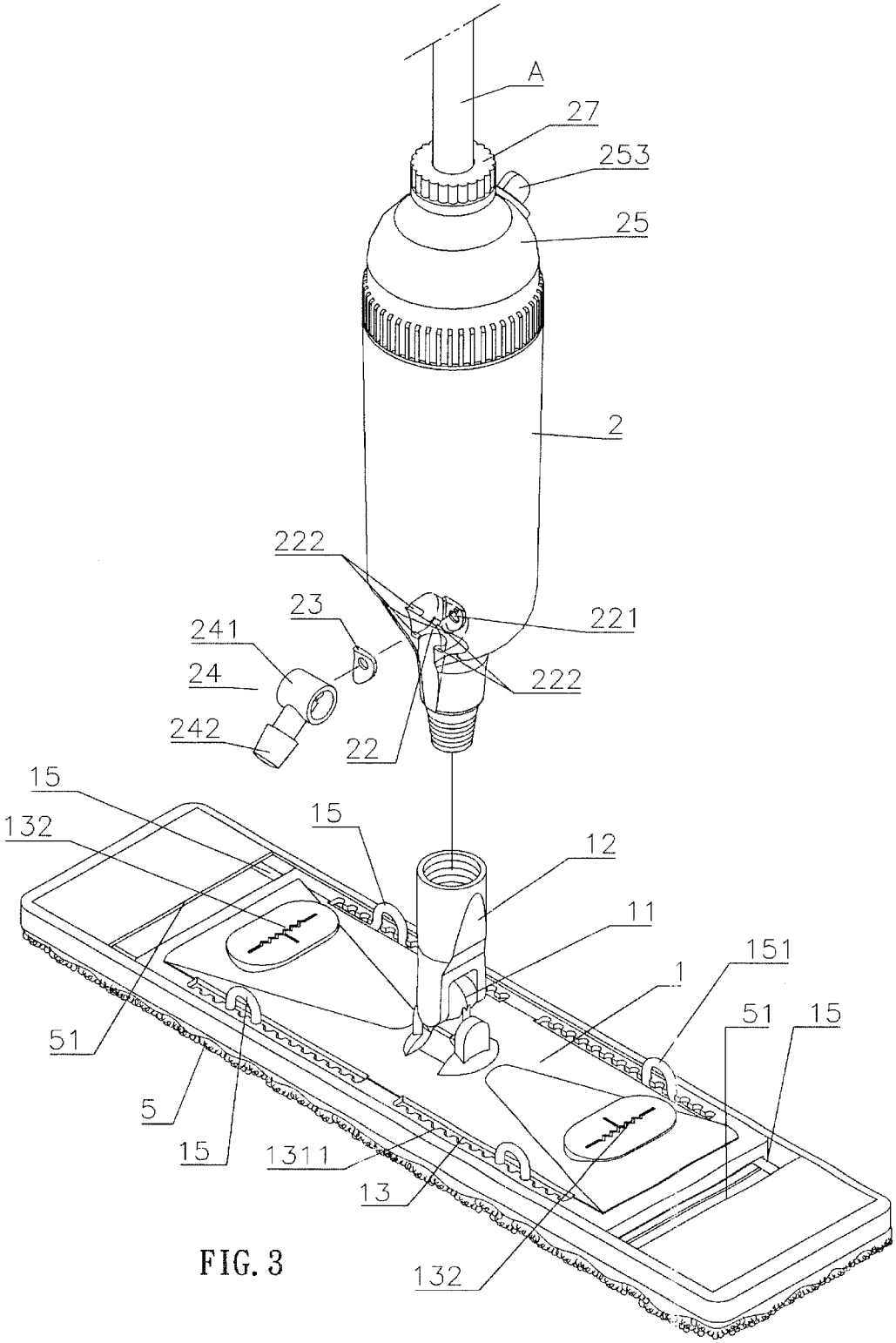
FIG. 3 is a perspective diagram of the disassembled parts of the outlet nozzle and storage bottle of the present invention.

Please refer to FIGS. 1, and 2 for the first preferred embodiment. In the figure, a mop 1 comprises a connecting pipe 12 pivotally coupled to a pivotal connector 11; a screw pipe 21 extended from the bottom of a storage bottle 2; a pivotal groove 22 disposed in the front end, wherein a flow hole being disposed at its center; a leak-proof spacer 23 surrounding the flow hole 221, and said pivotal groove 22 at its end opening having four flanges 222; an outlet nozzle 224 (refer to FIG. 3) having an arced rotary head 241 at one end and a spray nozzle 24 at the other end, through which an outlet passage 243 passes; said rotary head 241 is embedded and protruded from said flanges 222 into said pivotal groove 22 such that the flange just exceeds the diameter of said rotary head 241 and the outlet passage 243 in the rotary head 241 connects to said flow hole 221 under normal conditions. When said outlet nozzle 24 is moved vertically such that the outlet passage 243 separates from the flow hole 221 and blocks the liquid detergent by a leak-proof spacer 23 to stop the supply or leakage of liquid detergent; further, a fixed bottle cover 25 is secured onto another end of the storage bottle and a washer 251 is used to prevent leakage, and an inject hole 25 is disposed at an appropriate position of the fixed bottle cover 25 and sealed by a stopper 253 to facilitate the fill-up of liquid detergent; and an axial hole 254 is disposed at the top of said fixed bottle cover 25, and an O-shape ring 2542 is disposed on the hole edge 2541 at the bottom of the axial hole 254, and a radial fixing serration 255 is disposed on the surface of said central hole 2541; a push member 26 is disposed at the bottom of said fixing serration 255 having a sleeve 261 at one end, and a radial latch serration 262 is disposed at a position of said serration 255 corresponsive to the surface of the push member 26, and a limit member is extended from the bottom of the push member 26. When the sleeve 261 of said push member 26 is sheathed and secured onto the handle connecting pipe A and passes through the central hole 25 of said axial hole 254, the pipe wall of the handle connecting pipe A exactly presses against said O-shape ring 2542 and is secured into said axial hole 254 by a limit axle bolt 27 to limit the positions of the O-shaped ring 2542 and the handle connecting pipe A. In the meantime, the latch serration 262 of said push member 26 is engaged with the fixing serration 255 on the surface of said central hole 2541, and the limit member 26 at the bottom of said push member 26 is embedded into a limit groove 31 at the top of the curved pipe 3. The curved pipe 3 is connected to a suction pipe 32 extending into a storage bottle 2, and a sphere stopper is placed in a pump 4 at the position where such suction pipe 32 and its passage 33 are connected; a pump 4 having a sphere stopper 41 at its top is supported by a compressed spring 42 to press against the front end of a passage opening 411, and said compressed spring presses against a sealing stopper 43, and one end of said sealing blocking stopper is plugged into a piston 44 and a relay push pipe 45 presses against the bottom of said sealing stopper 43, while said relay push pipe 45 covers the lower end of said relay push pipe by a main push pipe 46, and the front end of the blocking edge 461 of the main push pipe 46 is sleeved from a main push pipe 45 by a bottle stopper 49 and embedded into the bottom of the pump 4 such that the bottle stopper 49 supports said piston 44 and the blocking edge 461 of the main push pipe 46 while keeping an appropriate distance between the piston 44 and the blocking edge 461 of the main push pipe 46 and pressing against the blocking edge 461 of the main push pipe 46 to prevent the main push pipe 46 from falling out. In the meantime, the lower end of the main push pipe 46 is embedded into the fixed hole 223 at the bottom of the storage bottle 2 and the outer periphery of the main push pipe 46 has a secondary spring 47 being supported between the bottom of the pump 4 and the bottom of the storage bottle 4, so that the handle connecting pipe A, push member 26, pump 4, main push pipe 46, connecting pipe 12, and mop 1 form a longitudinal line vertical to a central line, and the relay push pipe 45, main push pipe 46, fixed hole 223, flow hole 221, and the nozzle opening 242 of the outlet nozzle 24 constitute a liquid detergent passage.

Please refer to FIG. 1. Before the mop according to the present invention is used, inject the liquid detergent into the storage bottle 2 through the inject hole 252 and seal the bottle with a stopper 253, and follow the procedure as follows:

(1) Adjust the handle connecting pipe A according to the user's height or requirements and secure it to the sectional handle. To prevent the pump 4 in the storage bottle 2 from being rotated when securing the handle, use the upward pushing force of the compressed spring 42 in the pump 4 and the secondary spring 47 at lower end of the pump to prop the push member 26 towards the surface of the central hole 2541 at the top of the interior of the storage bottle 2, and engage the latch serration 262 on the push member 262 and the fixed serration 255 on the surface of the central hole 2541 such that the fixed push member 26 and the handle connecting pipe A will not rotate as the sectional handle is being secured.

Figure 4A:
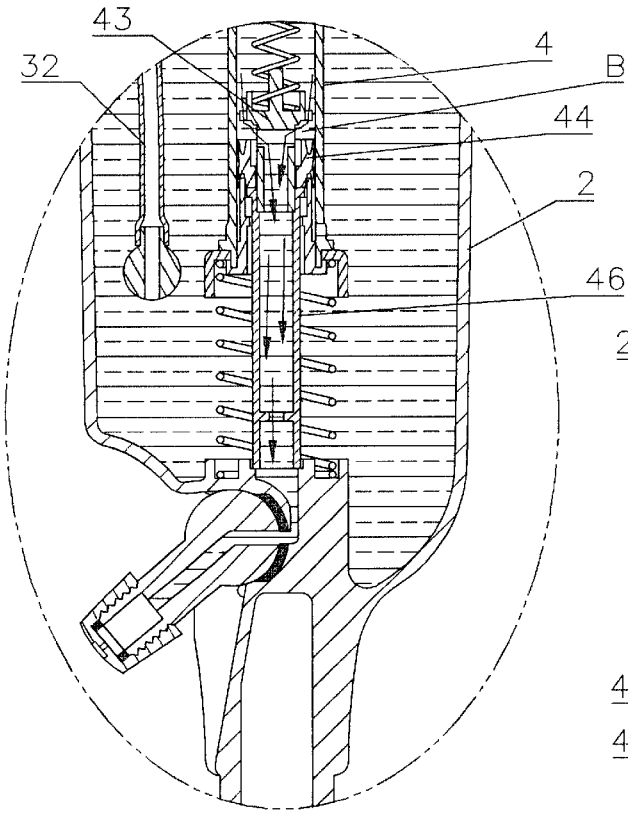
FIG. 4A is an enlargement of a part of FIG. 4.
Figure 4:
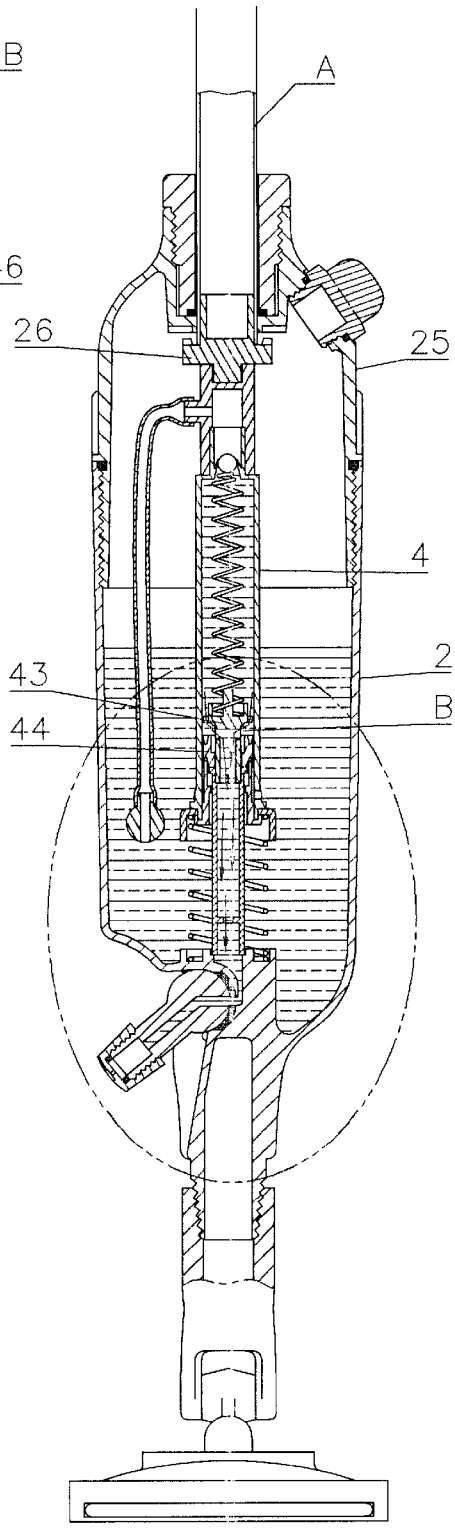
FIG. 4 is a cross-sectional diagram illustrating the first step of the movement according to a preferred embodiment of the present invention.

(2) Please refer to FIGS. 4 and 4A. Before the mop of the present invention has ever been used, there is no liquid detergent W in the pump 4. When the handle A erects the storage bottle 2 to a vertical position, the handle is in the most power saving condition for compressing the pump 4, therefore when the handle connecting pipe A compresses the push member 26, the pump 4 sinks and the main push pipe 46 relatively enters into the pump 4 while pushing the sealing stopper 43 up and separating the piston 44 and leaving a gap B behind. Please refer to FIGS. 5 and 5A. The relay push pipe 45 keeps on being pushed forward by the main push pipe 46 and the blocking edge 461 of the main push pipe 46 in turn pushes the piston 44 to squeeze the air in the squeezing chamber 48 in the pump 4. The sphere stopper 41 squeezed by the air pressure on one hand, and pushed by the compressed spring 42 on the other hand clogs the passage opening 411. The air is compressed by the piston 44, and enters through the gap B into the relay push pipe 45, main push pipe 46, flow hole 221. and nozzle opening 242 of outlet nozzle 24, and then discharge the air.

Figure 6A:
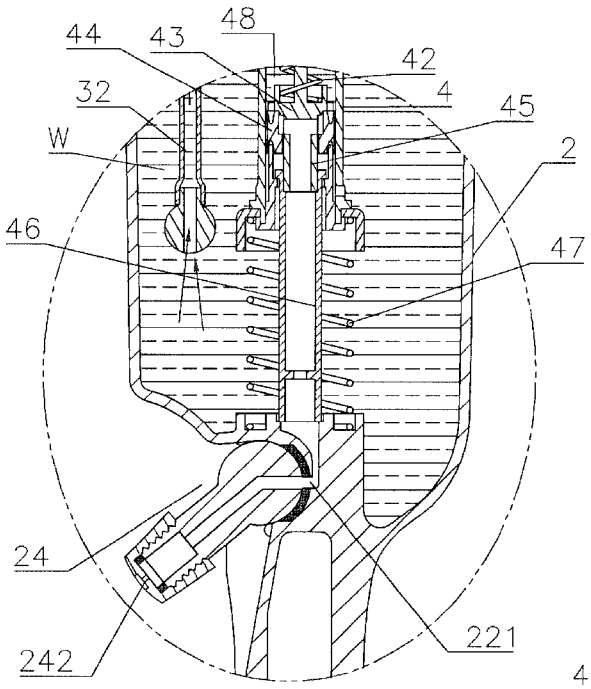
FIG. 6A is an enlargement of a part of FIG. 6.
Figure 6:
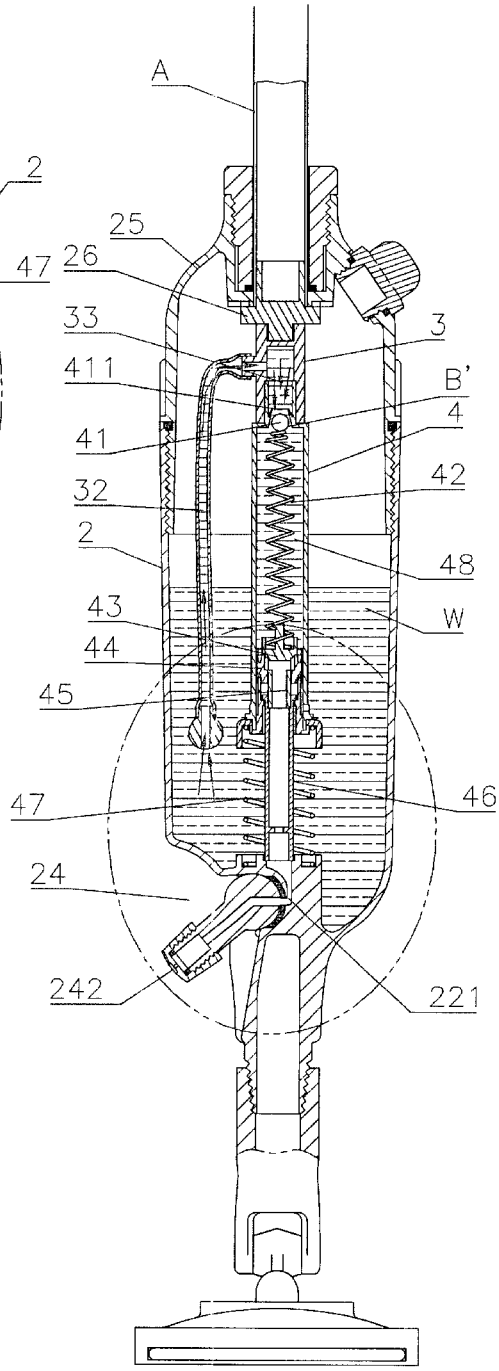
FIG. 6 is a cross-sectional diagram illustrating the third step of the movement according to a preferred embodiment of the present invention.

(3) Please refer to FIGS. 6 and 6A. If the user no longer pushes the handle A, then the resuming forces of the compressed spring 42 in the pump 4 and the secondary spring 47 are used to push the pump 4 upward, while the piston 44 uses the friction of the inner wall of the pump 4 to keep the piston 44 still in the original position. The sealing stopper 43 drops to the position of the piston 44 and clog the gap B. At that time, since the pump 4 rises, it is equivalent to the drop of the piston 44 to extract the air in the squeezing chamber 48 of the pump 4 such that the sphere stopper 41 is separated from the passage opening 411 by the suction and forms a gap B. Such suction sucks the liquid detergent W by the suction pipe 32 through the curved pipe 3, passage 33, passage opening 411, gap B' and then into the squeezing chamber 48 of the pump 4 for temporary storage.

Figure 5A:
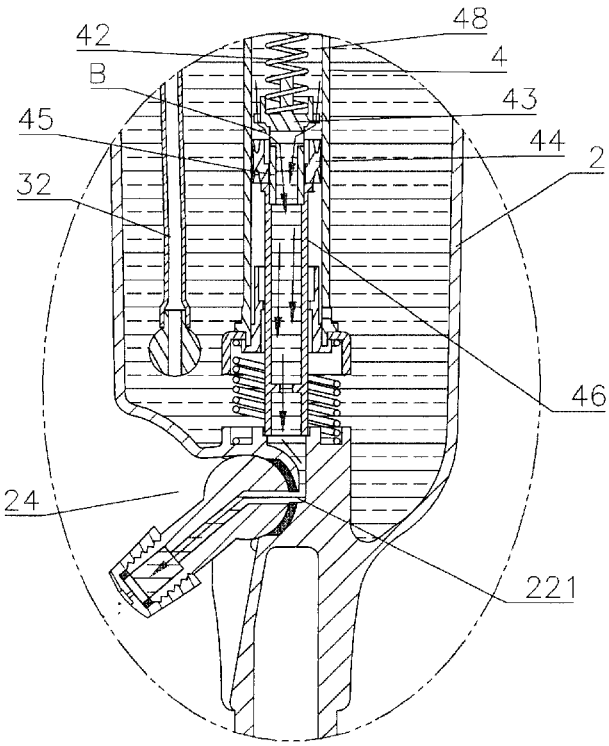
FIG. 5A is an enlargement of a part of FIG. 5.
Figure 5:
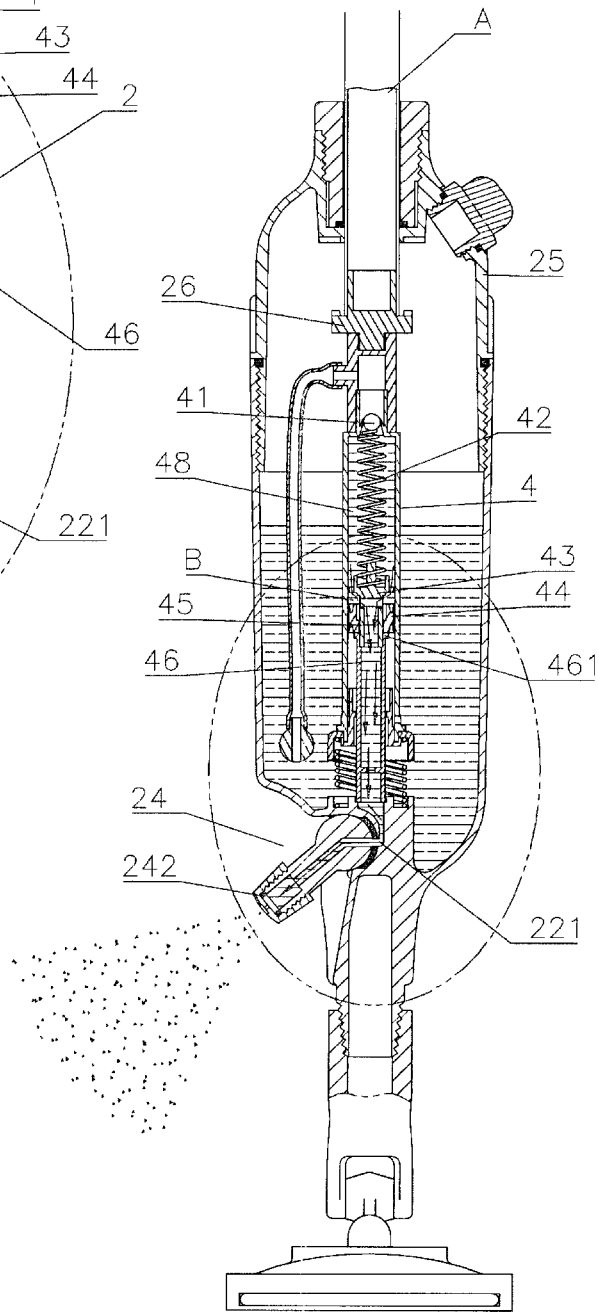
FIG. 5 is a cross-sectional diagram illustrating the second and fourth steps of the movement according to a preferred embodiment of the present invention.

(4) The liquid detergent W temporarily stored in the squeezing chamber 48 is blocked by the sealing between the sealing stopper 43 and the piston 44, and squeezed by the piston 44 according to the previous step (2), which is also shown in FIGS. 5 and 5A. The liquid detergent is squeezed into the relay push pipe 45 through the gap B between the sealing stopper 43 and the piston 44, and then sprayed out through the main push pipe 46, flow hole 221, and nozzle opening 242 of the outlet nozzle 24.

(5) In the foregoing step, the back and forth movement of the handle can squeeze and resume the pump 4 to spray the required quantity of the liquid detergent.

Figure 7:
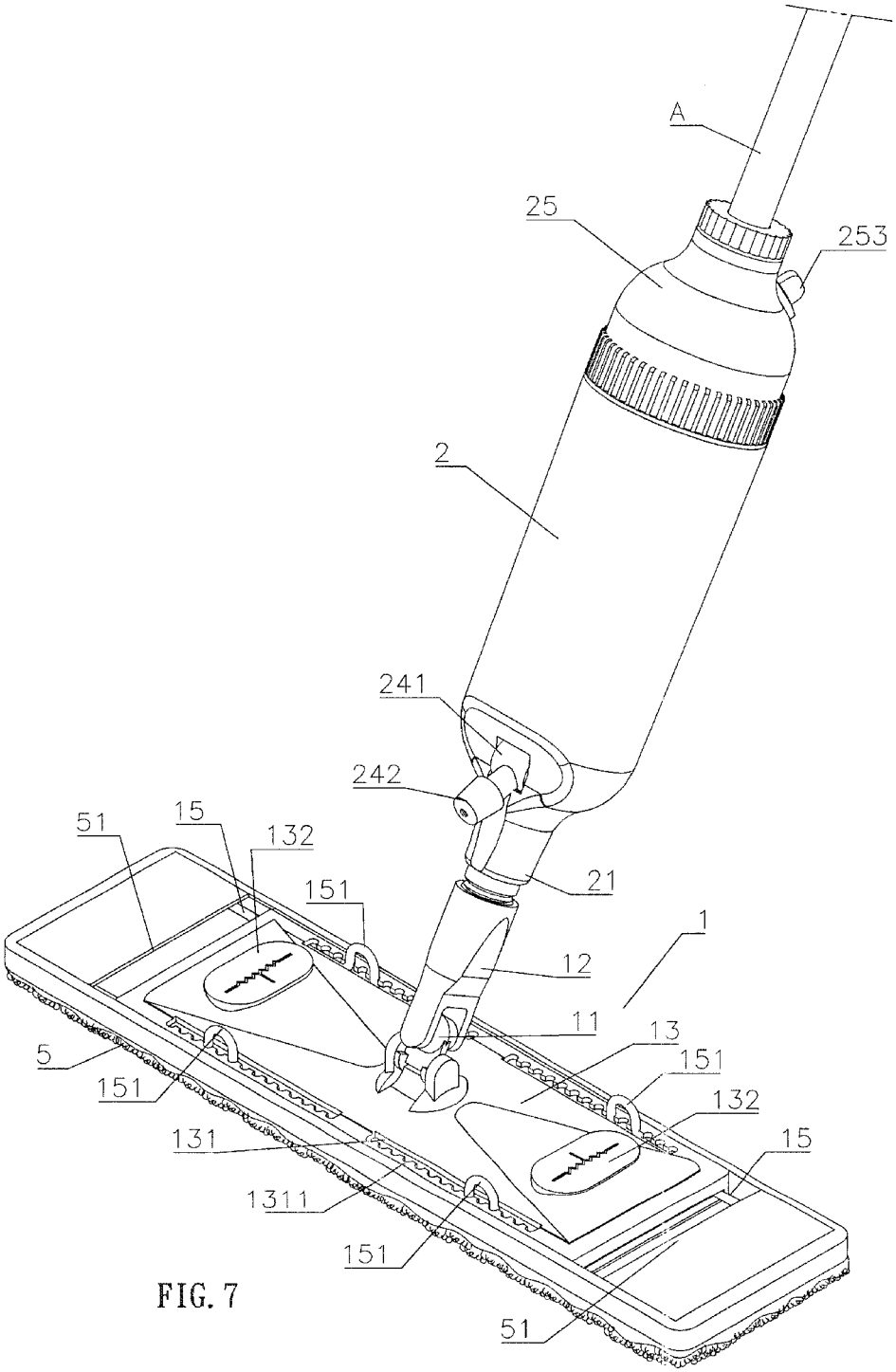
FIG. 7 is an illustrative diagram of the present invention when it is in use.

(6) The handle is usually set to an appropriate angle to use the mop (as shown in FIG. 7), and the mop 1 is placed in front of the user to facilitate the movement of the mop. Therefore the force exerting on the pump 4 produced by the inclination of the handle plus the resisting forces by the compressed spring 42 and the secondary spring 47 will not sufficient to squeeze the pump 4 when a pushing force is applied onto the mop when it is in use.

Figure 8:
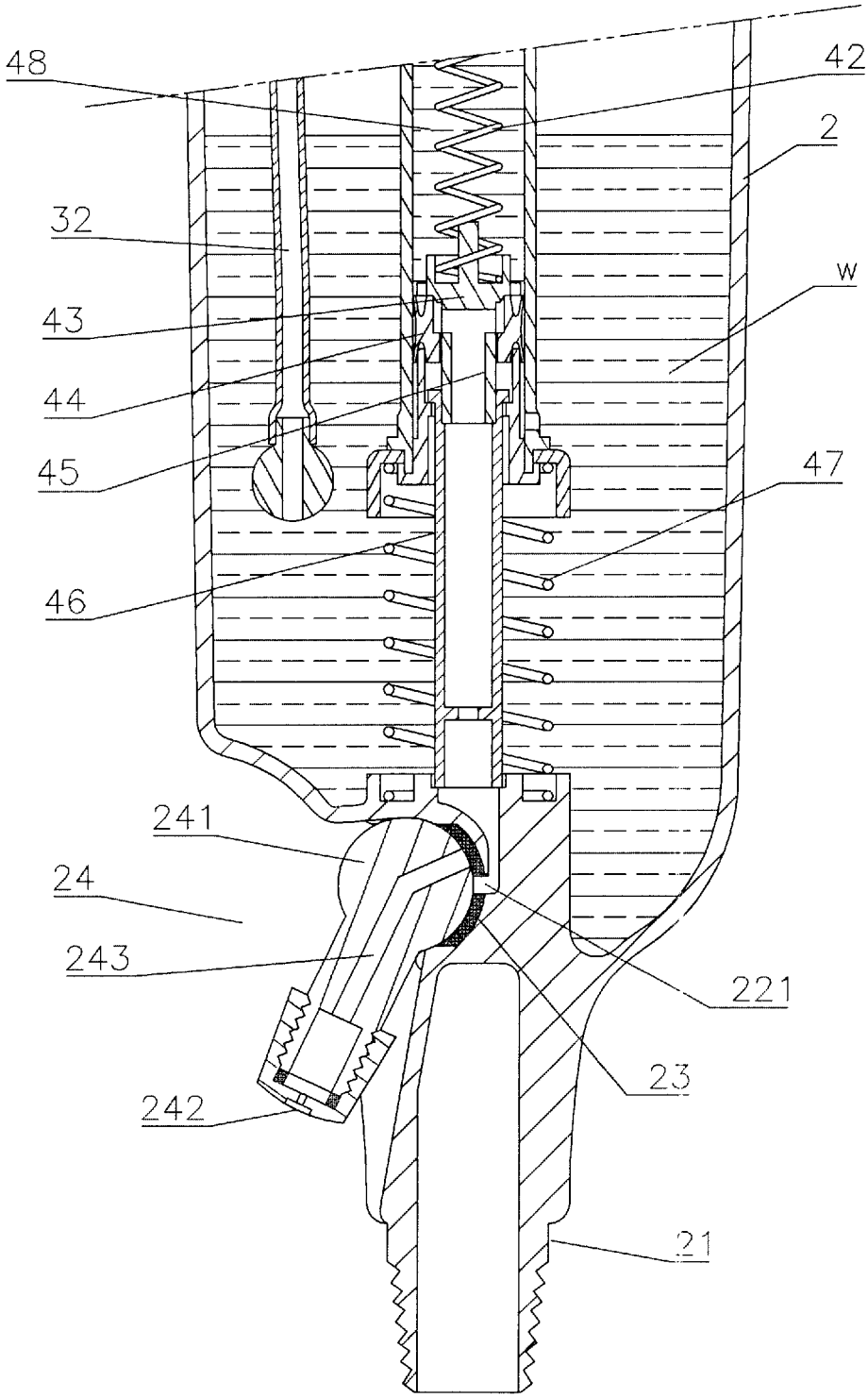
FIG. 8 is a cross-sectional diagram showing the operation of the outlet nozzle according to the present invention.

(7) Please refer to FIG. 8. To prevent the mop of the present invention from dripping the liquid detergent remained in the nozzle opening or spraying the detergent by accidentally trigger the handle to squeeze the pump 4, the outlet nozzle 24 can be lifted upward to detach the outlet passage 243 from the flow hole 211 and seal by the anti-leakage spacer 23 to prevent further spray of liquid detergent. Please refer to FIG. 9 for the second preferred embodiment of the present invention. In the figure, the pump 4' has a structure identical to the pump 4 of the first preferred embodiment. The difference resides on that the position of the pump 4' has an inverted position of the previous pump 4, and the structure of the pump 4' is to extend the passage opening 411' of the pump 4' to a suction pipe 32', and be embedded and limited on a limit pillar C protruded from the storage bottle 2, and such suction pipe 32' at its bottom has a suction opening 321', The push member 26 identical to that of the first embodiment having a limit member 263 directly embedded into the main push pipe 46' of the pump 4, and said main push pipe 46' connects a conveying pipe D to an outlet passage 243' of the outlet nozzle 24' and is fixed into the axial hole 254 of the fixed bottle cover 25. The secondary spring 47' is placed in said axial hole 254 and a press board A1 fixed on the handle connecting pipe presses said secondary spring 47'. By means of passing the handle connecting pipe A into a limit cover E and securing it above the axle hole 254 of the fixed bottle cover 25 such that the secondary spring 47' can be compressed and resumed in the axial hole 254 by the back and forth squeezing movement of the handle.

Figure 10:
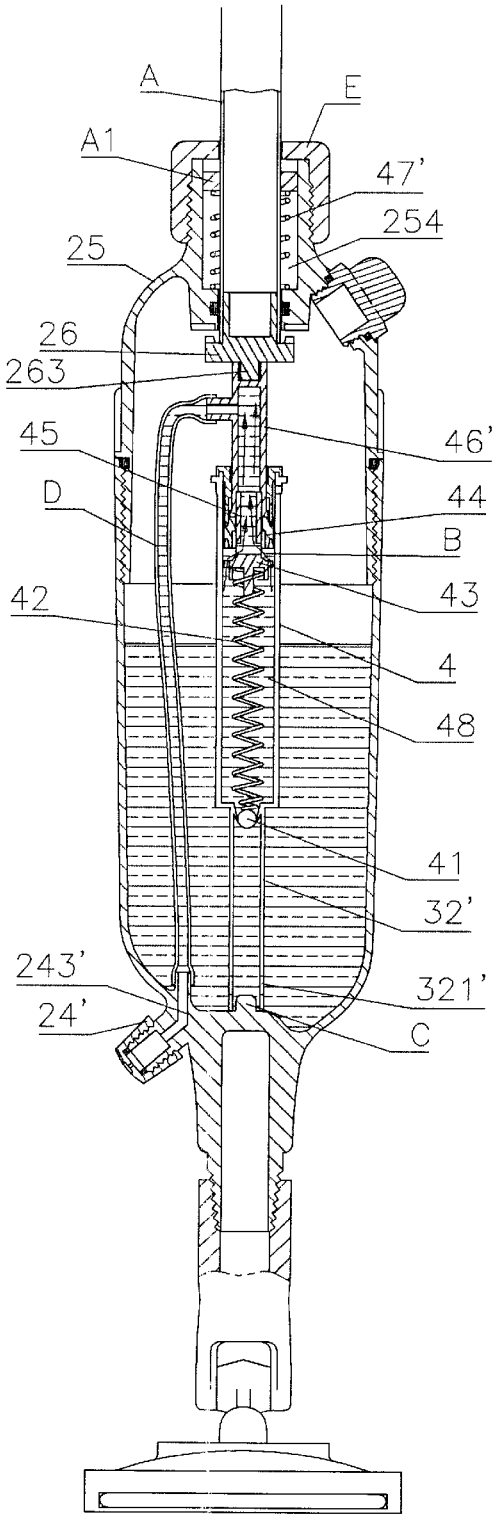
FIG. 10 is a cross-sectional diagram illustrating the first step of the movement according to a second preferred embodiment of the present invention.

The operation procedure is as follows:

(1) Please refer to FIG. 10. If the handle connecting pipe A pushes the push member 62 to sink the main push pipe 46', and the main push pipe 46 relatively enters into the pump 4', while pressing the sealing stopper 43 down, and separating the piston 44 to form a gap B between them. Please refer to FIG. 11. Said relay push pipe 45 keeps on being pushed forward by the main push pipe 46', and the blocking edge 461 pushes the piston 44 to squeeze the liquid detergent W in the squeezing chamber 48 of the pump 4'. The sphere stopper 41 is pressed by the pressure on one hand, and pushed by the compressed spring 42 on the other hand to block the passage opening 411'. Therefore, the liquid detergent W is compressed by the piston 44 to enter into said gap B and then into the relay push pipe 45, main push pipe 46, conveying pipe D, the outlet passage 243' of the outlet nozzle 24', and then discharged from the nozzle 242'.

Figure 9:
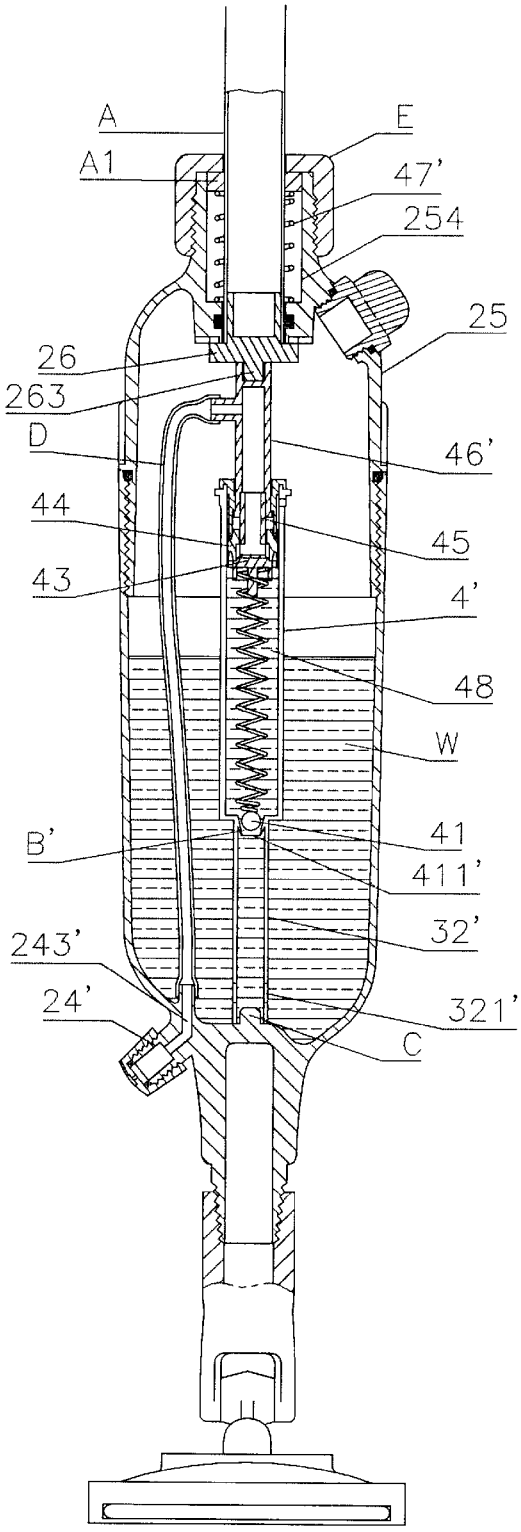
FIG. 9 is a cross-sectional diagram of the assembled parts according to a second preferred embodiment of the present invention.
Figure 11:
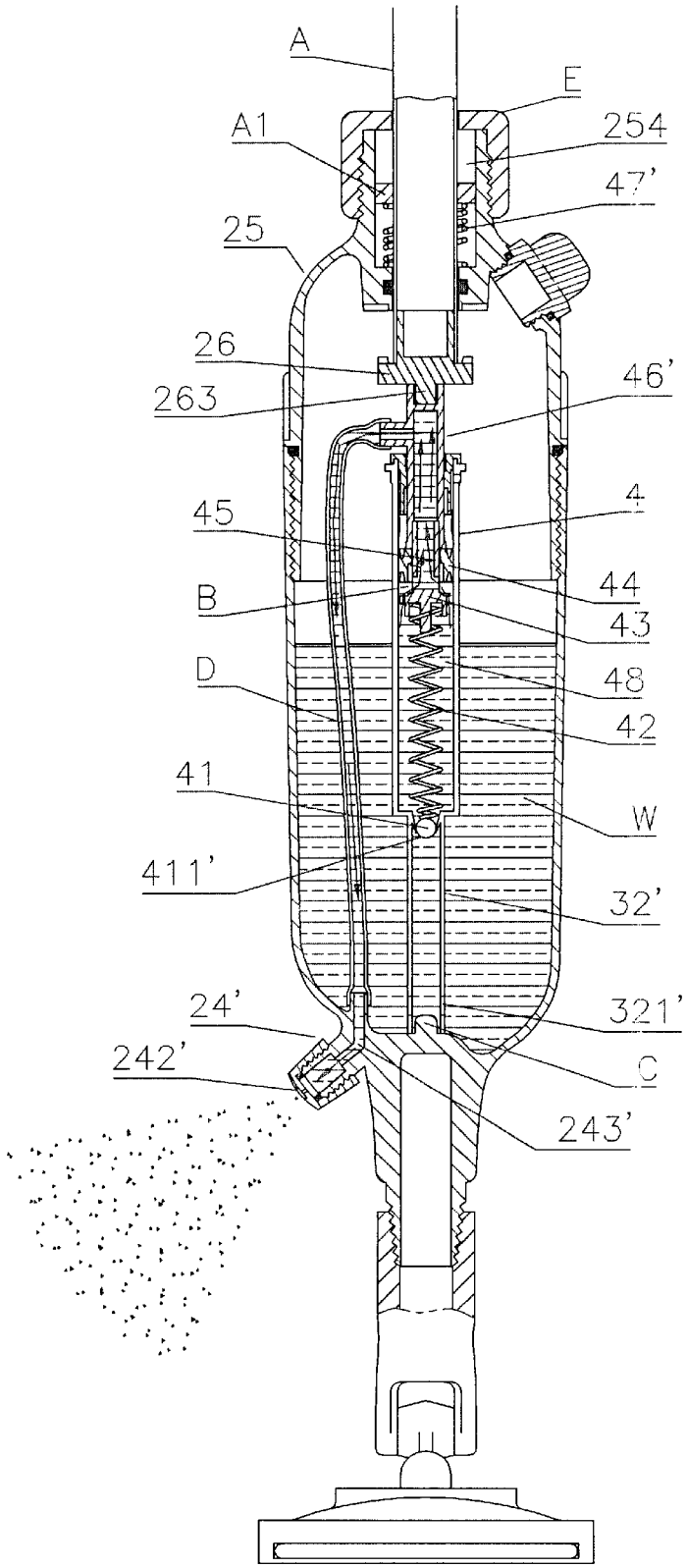
FIG. 11 is a cross-sectional diagram illustrating the second step of the movement according to a second preferred embodiment of the present invention.

(2) If the user no longer pushes the handle A, but resumes the movement as shown in FIG. 11 to the movement as shown in FIG. 9. Therefore, the resuming force by the compressed spring 42 and the secondary spring 47' in the pump 4' is used to push the main push pipe 46' up, while the pistons 44 uses the friction on the inner wall of the pump 4' to drop the piston 44 to the position of the sealing stopper 43 and blocks the gap B. At that time, since the main push pipe 46' rises, it relatively makes the piston to pump the liquid detergent W in the squeezing chamber 48 of the pump 4' and separates the sphere stopper 41 from the passage opening 411' by said suction to form a gap. Such suction sucks the liquid detergent W through the suction opening 321 and the suction pipe 32' and the gap B' into the squeezing chamber 48 of the pump 4' for temporary storage.

(3) The required quantity of liquid detergent can be sprayed by the back and forth squeezing and resuming movement of the handle on the bump 4' as described in the previous step.

Figure 12:
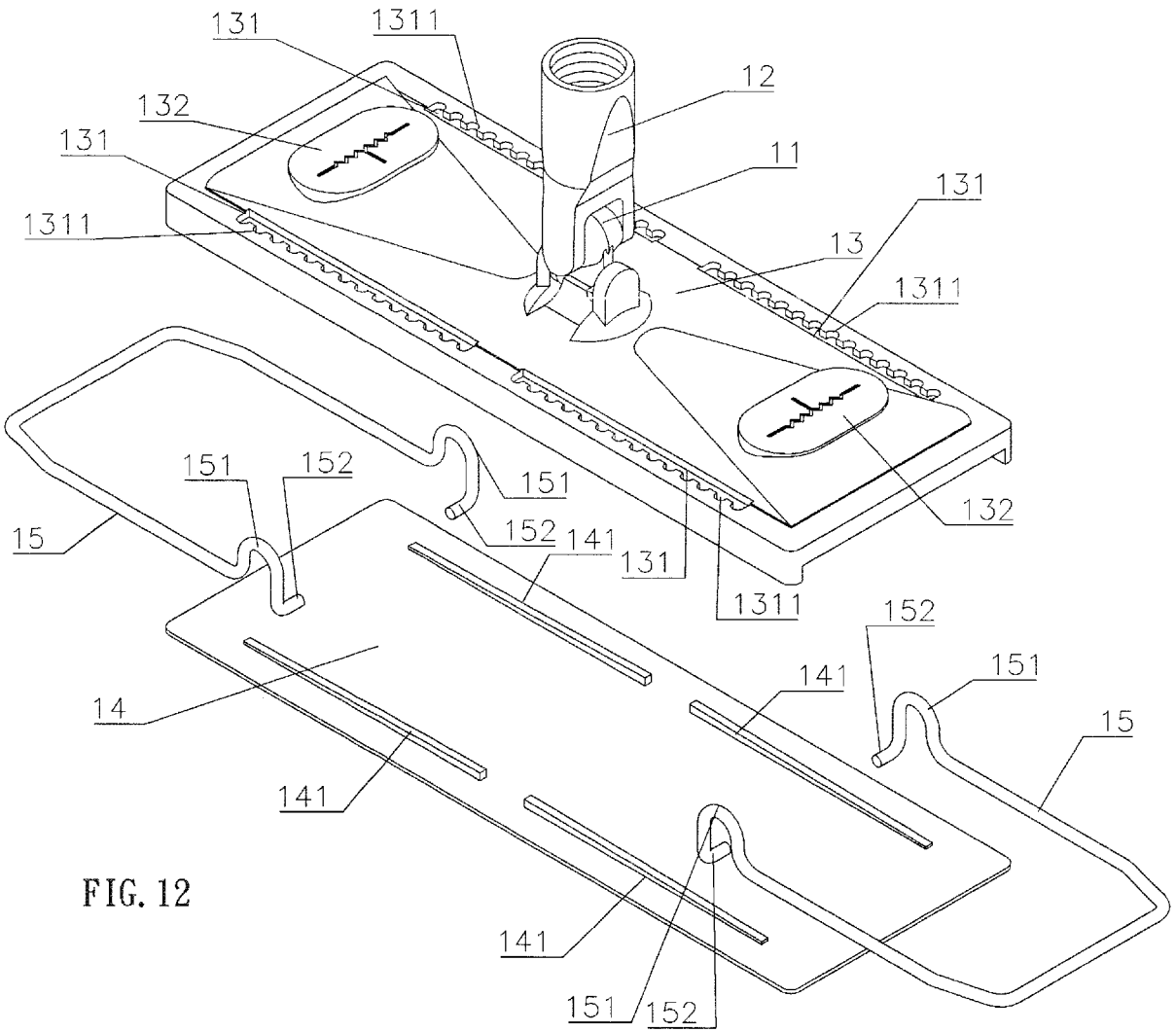
FIG. 12 is a perspective diagram of the disassembled parts of the mop according to the present invention.
Figure 13:
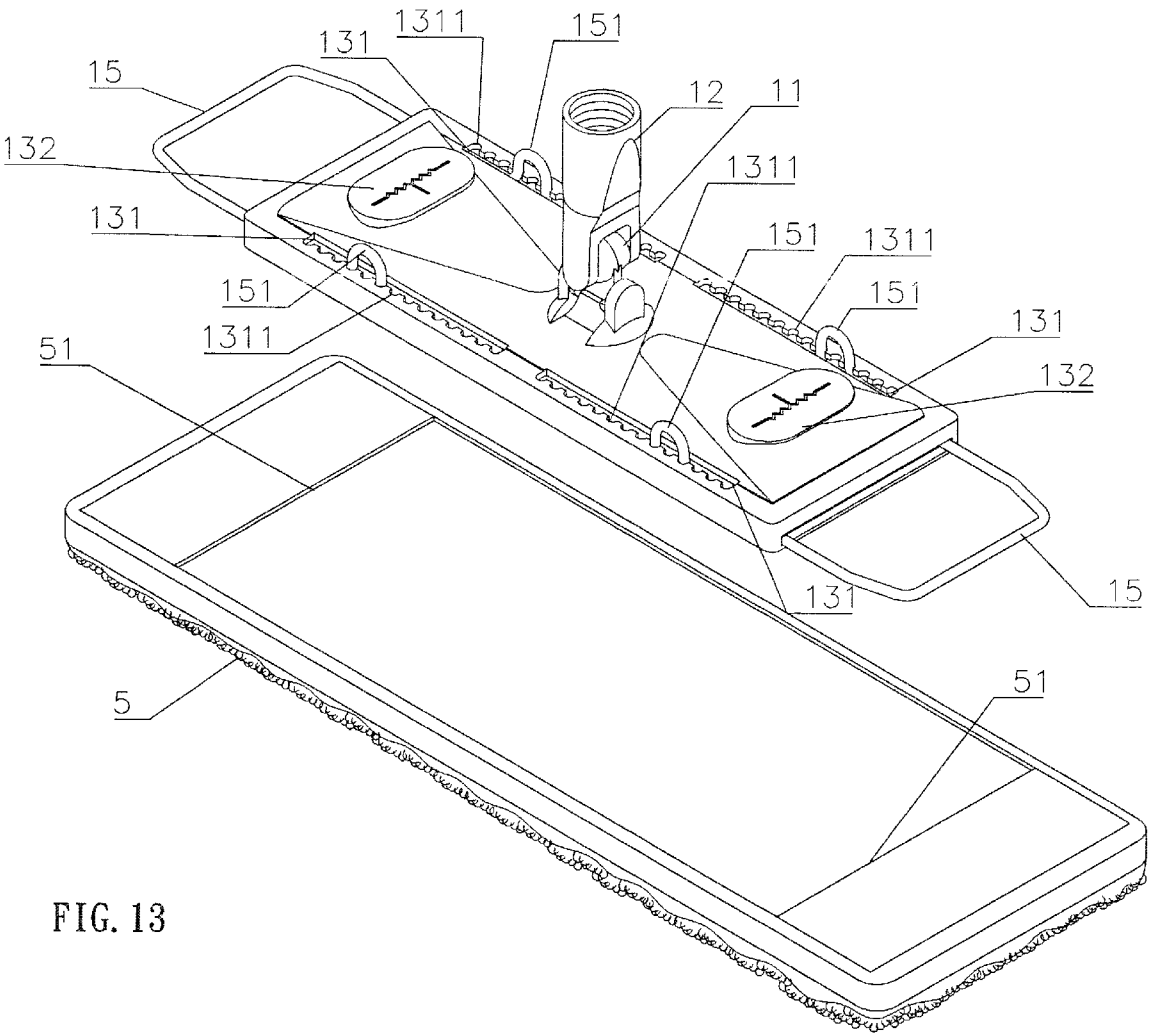
FIG. 13 is a perspective diagram of the assembled parts of the mop according to the present invention.
Figure 13A:
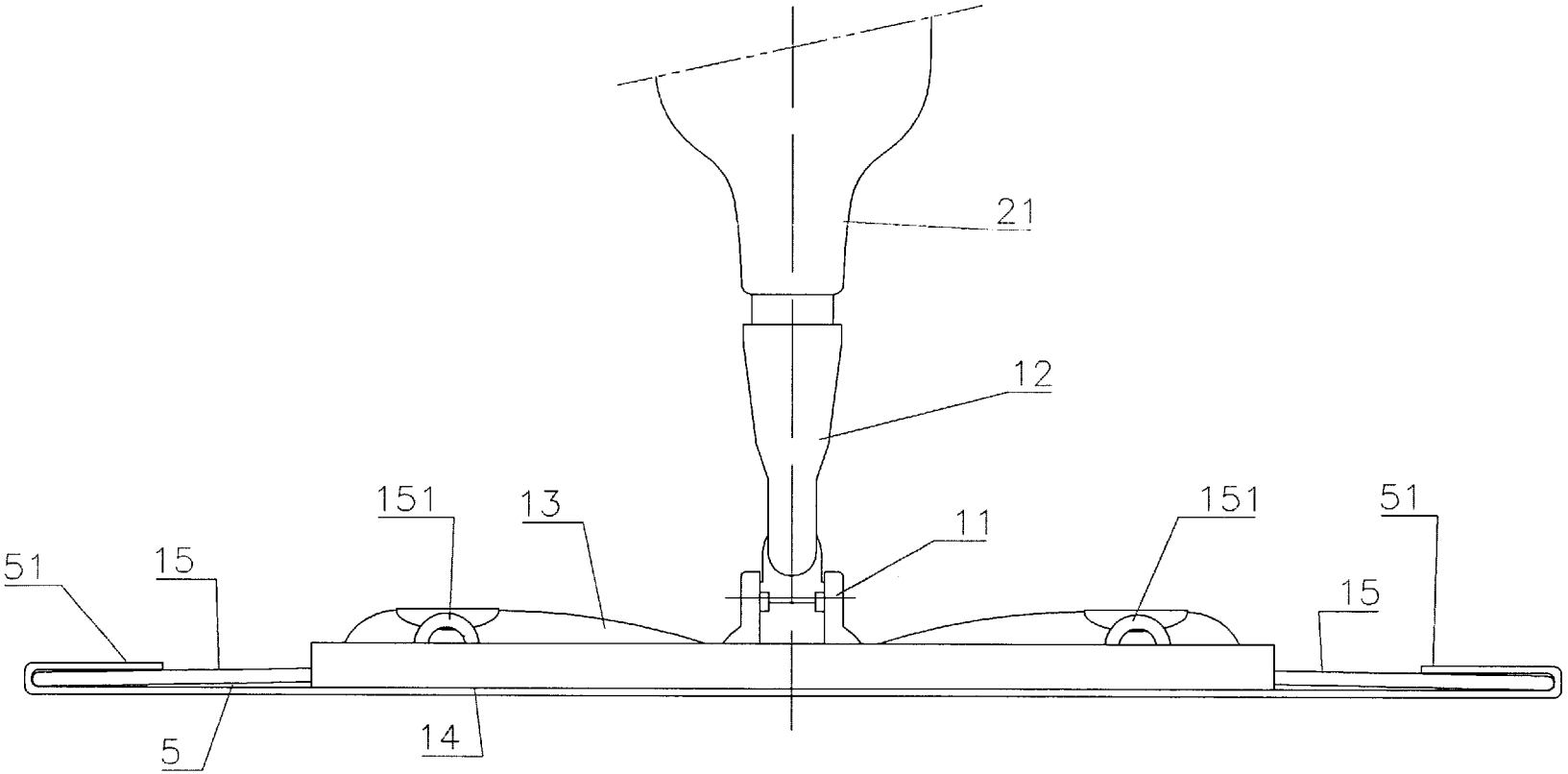
FIG. 13A is a planar illustrative diagram of the mop according to a preferred embodiment of the present invention.
Figure 14:
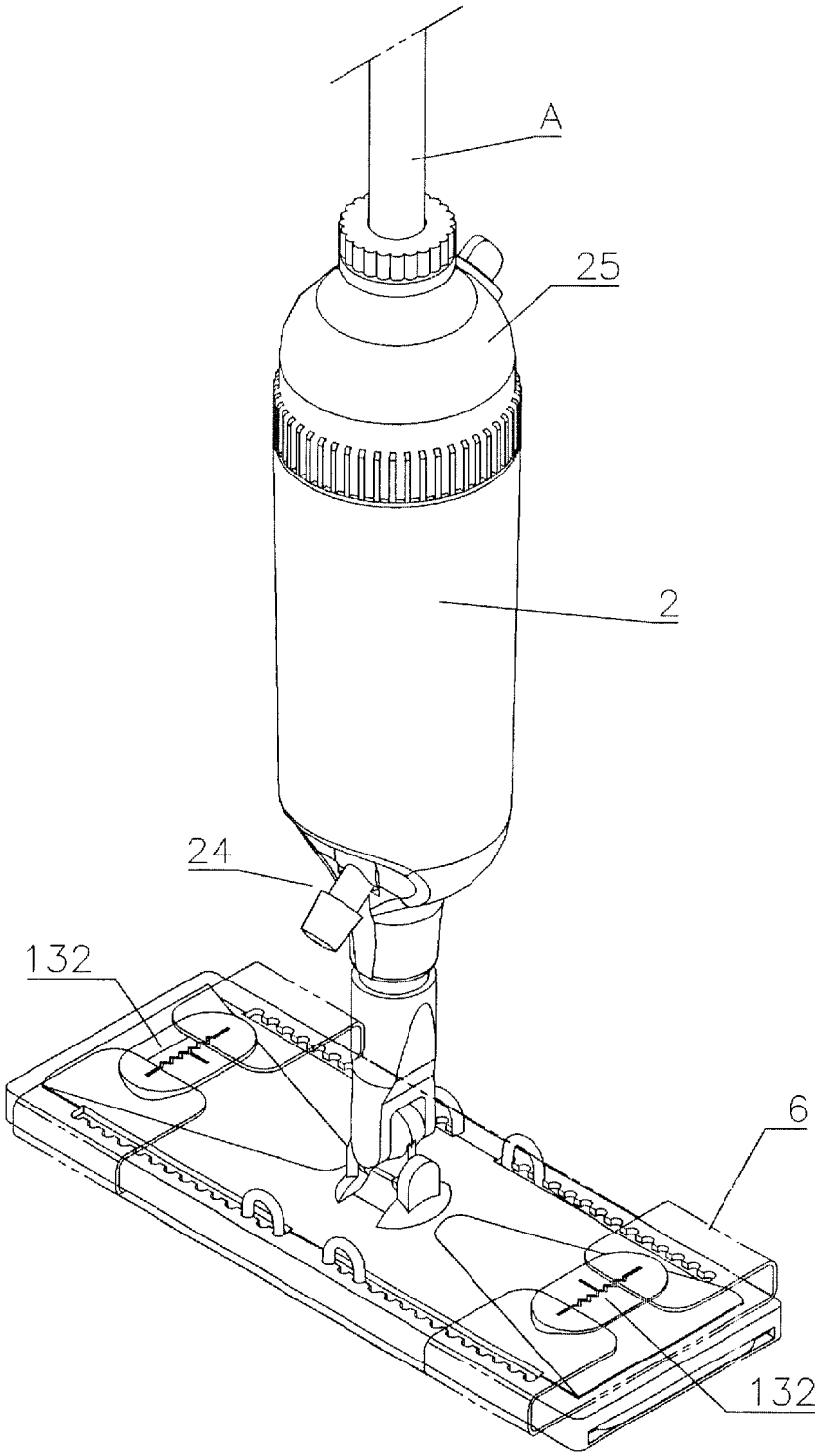
FIG. 14 is a perspective diagram of the mop according to another preferred embodiment of the present invention.

Please refer to FIGS. 12 and 13. The mop 1 comprises a board body 13 and a board surface 14; a serrated latch groove 131 disposed respectively at the front and the rear ends of the board body 13, and a plurality of soft clipping boards 132 disposed thereon; a board surface 14 having an aslant sliding track 141 inclined towards both sides of the board surface 14; two n-shape contractible support rod 15 disposed on both sides of the opening end respectively having an vertically upward protruded ear 151 and a sliding rod 152 extended towards the inner side. When the n-shape contractible rod 15 is disposed at the bottom of the board body 13, the protruded ear 151 exactly passes through the serrated latch groove 131 and latches the protruded ear 151 into the latch groove 1311 of the serrated latch groove 131 by the elasticity of the n-shape contractible support rod 15. The aslant sliding track 141 exactly presses against the sliding rod 152 of the n-shape support rod 15 by means of combining the board surface 14 and the board surface. When the protruded ear 151 on both sides of the n-shape contractible support rod 15 is held inward, said protruded ear 151 will separate from the latch groove 1311 of the serrated latch groove 131 and contract the n-shape contractible support rod 15 towards both sides of the mop 1. If the protruded ear is released, the n-shape contractible support rod 15 is latched in the latch groove 1311. The aslant sliding track 1411 is used to tilt the sliding rod 152 aslant to both sides. Please refer to FIG. 7. If the length of the cloth exceeds the length of the board body of the mop 1, the n-shape contractible support rod 15 is used to pass the cleaning cloth 5 into the two side pockets and extend outward. The outwardly aslant n-shape contractible support rod 15 guides both ends of the cleaning cloth to attached on the same plane as the cleaning cloth attached on the foregoing board surface 14 (as shown in FIG. 13A) to improve the effect of using the whole pieces of the cleaning cloth 5. Please refer to FIG. 14. The mop 1 has a soft clipping board 132 for engaging the polyester cloth or other cleaning cloth 6 for having a multiple effect on the applications.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved mop assembly with a liquid detergent supply, comprising:

a mop, having a connecting pipe pivotally coupled with a pivotal connector;

a storage bottle, having a screw pipe extended from the bottom and secured onto said connecting pipe, and an outlet nozzle disposed at the front end of said storage bottle;

a fixed bottle cover, being coupled with said storage bottle, and sealed by an anti-leak spacer, and having a liquid detergent inject hole disposed at an appropriate position on the fixed bottle cover and using a bolt for sealing and filling up with liquid detergent; an axial hole disposed at the top of said fixed bottle cover; an O-shape ring disposed at the hole edge of the central hole at the bottom of the axial hole, and a limit axle bolt for securing said O-shape ring into the axial hole;

a push member, having a sleeve on one end, and a limit member extended from the bottom of said push member;

a handle connecting rod, passing through said limit axle bolt and embedded into the sleeve of said push member;

a curved pipe, having a limit groove for passing and limiting the limit member of said push member, and a suction pipe coupled to an appropriate position to connect a passage and a passage opening;

a pump, having a passage opening at the top coupled to the passage of said curved pipe, and the main push pipe at its bottom being embedded into a fixed hole at the bottom of said storage bottle, such that the pump being located between said push member and the bottom of said storage bottle; thereby the back and forth squeezing movement and the resuming movement of the handle sucking the liquid detergent from the suction pipe into the pump and then the piston in the pump squeezing the desired quantity of liquid detergent from the main push pipe and spraying from the nozzle of the outlet nozzle in order to achieve the effect of convenient use, easy assembling, stable operation, and cost cut.

2. The improved mop assembly with liquid detergent supply as claimed in claim 1, wherein said outlet nozzle having an arc rotary head at one end, and a spray nozzle on the other end, an outlet passage passing through said outlet nozzle; a pivotal groove being disposed in the front end of the storage bottle and having a flow hole at its center; an anti-leak spacer surrounding the flow hole, and a flange disposed around the opening of the pivotal groove for embedding the rotary head into the pivotal groove of the storage bottle, and preventing leakage by the positioning of said flange and anti-leak spacer, while the outlet nozzle providing the vertically pulling.

3. The improved mop assembly with liquid detergent supply as claimed in claim 1, wherein said fixed bottle cover having a radial fixed serration disposed on the end surface of the central hole of said fixed bottle, and a radial latch serration disposed on said push member at a position corresponsive to the surface of said fixed serration, so that the fixed serration and the latch serration being engaged together to prevent the pump from rotating.

4. The improved mop assembly with liquid detergent supply as claimed in claim 1, wherein said pump having a secondary spring at the bottom to enhance the resuming force of the pump.

5. The improved mop assembly with liquid detergent supply as claimed in claim 1, characterized in that said pump having a sphere stopper at the top of said pump, and propped by a compressed spring to press against the passage at the front end of the pump, and said compressed spring pressing against a sealing stopper at the other end, and said sealing stopper being plugged onto a piston, and said sealing stopper at its bottom being pressed by a relay push pipe, while said relay push pipe at its bottom being covered by a main push pipe, and said push pipe at its front end having a blocking edge to block the piston, and a sleeve passing through said main push pipe and being embedded and secured to the bottom of the pump, so that the pump supporting said main push pipe while the piston and the blocking edge of said main push pipe maintaining an appropriate distance and blocking the blocking edge of the main push pipe to prevent the main push pipe from falling out, and the bottom of said main push pipe being embedded to the fixed hole at the bottom of the storage bottle, and supported between the bottom of the pump and the bottom of the storage bottle.

6. The improved mop assembly with liquid detergent supply as claimed in claim 1, wherein said handle connecting pipe, push member, bump, main push pipe, supporting pipe, and mop are aligned in a longitudinal direction vertical to a central line.

7. The improved mop assembly with liquid detergent supply as claimed in claim 1, wherein said relay push pipe, main push pipe, fixed hole, flow hole, and nozzle of the outlet nozzle forming a liquid detergent passage.

8. An improved mop assembly with a liquid detergent supply, comprising a board body and a board surface, and said mop being used with a piece of cleaning cloth or polyester cloth of the same specification, characterized in that:

two n-shape contractible support rod, respectively disposed on both sides of an opening end, having a vertical protruded ear, and a sliding rod extended towards the inner side, and said protruded ear being latched by a serrated latch groove of said board body, and an elasticity between both ends of said protruded ear providing users to release and resume the latch;

a board body, having a plurality of soft clipping boards at appropriate positions thereon, and a serrated latch groove each disposed on both the front and rear sides of said board body; a plurality of latch grooves disposed in intervals on the latch groove for allowing said protruded ear to move sideway in the serrated latch groove, and fixing said protruded ear into the latch groove by the elasticity between two protruded ears, a board surface, respectively having an slant sliding track tilted sideway such that said sliding rod of the two contractible support rod respectively disposed on the aslant sliding track when coupled with said board body pushing out towards both sides and being tilted outward according to the inclination of said aslant sliding track; thereby when the length of cleaning cloth exceeding the length of the mop, the sliding rod of the n-shape contractible support rod being used to pass into a pocket each on both sides of the cleaning cloth and spread out the cleaning cloth, and the outwardly tilted n-shape contractible support rod guiding both ends of the cleaning cloth to attach on the same surface as that for said board surface of the cleaning cloth in order to enhance the entire cleaning effect of the cleaning cloth and fitting the cleaning cloths of different specifications.

9. The improved mop assembly with liquid detergent supply as claimed in claim 8, wherein an inverted pump having a passage opening, a suction pipe being embedded and limited onto a limit pillar protruded from a storage bottle, a suction opening being disposed at the bottom of the suction pipe, and a main push pipe directly coupling to a conveying pipe and to an outlet passage of an outlet nozzle.

10. The improved mop assembly with liquid detergent supply as claimed in claim 9, wherein an axial hole of a fixed bottle cover having a secondary spring, and a press board fixed on a handling connecting pipe pressing against said secondary spring, and a limit cover being secured on said axial hole such that said secondary spring being compressed and resumed in the axial hole by means of the back and forth squeezing movement of a handle connecting rod.

* * * * *